US007243798B2

(12) United States Patent
Buss

(10) Patent No.: US 7,243,798 B2
(45) Date of Patent: Jul. 17, 2007

(54) SYSTEM AND A METHOD FOR A V-INDENT BLISTER OPENING CAVITY

(75) Inventor: Michael Adam Buss, Breinigsville, PA (US)

(73) Assignee: Fisher Clinical Services, Allentown, PA (US)

( * ) Notice: Subject to any disclaimer, the term of this patent is extended or adjusted under 35 U.S.C. 154(b) by 186 days.

(21) Appl. No.: 10/912,416

(22) Filed: Aug. 4, 2004

(65) Prior Publication Data

US 2006/0027480 A1 Feb. 9, 2006

(51) Int. Cl.
*B65D 83/04* (2006.01)
*B65D 85/42* (2006.01)

(52) U.S. Cl. ..... 206/531; 206/469; 206/532; 206/539

(58) Field of Classification Search ..... 206/531–532, 206/538–539, 469
See application file for complete search history.

(56) References Cited

U.S. PATENT DOCUMENTS

| | | | | |
|---|---|---|---|---|
| 2,652,149 | A | 9/1953 | O'Meara | |
| 3,381,808 | A | 5/1968 | McGraw, II | |
| 3,630,346 | A | 12/1971 | Burnside | |
| 3,809,221 | A | 5/1974 | Compere | |
| 3,835,995 | A | 9/1974 | Haines | |
| 3,888,350 | A | 6/1975 | Horvath | |
| 3,921,805 | A | 11/1975 | Compere | |
| 3,931,885 | A | 1/1976 | Nahill et al. | |
| 3,941,248 | A | 3/1976 | Moser et al. | |
| 4,113,098 | A | 9/1978 | Howard | |
| 4,125,190 | A | 11/1978 | Davie, Jr. et al. | |
| 4,126,224 | A | 11/1978 | Laauwe | |
| 4,192,422 | A | 3/1980 | Kotyuk | |
| 4,211,329 | A | 7/1980 | Braverman | |
| 4,294,361 | A | 10/1981 | Margulies et al. | |
| 4,340,141 | A | 7/1982 | Fischer | |
| 4,364,488 | A | 12/1982 | Anjou | |
| 4,371,080 | A * | 2/1983 | Haines | 206/531 |
| 4,398,634 | A | 8/1983 | McClosky | |

(Continued)

FOREIGN PATENT DOCUMENTS

| | | | |
|---|---|---|---|
| EP | 0 393 942 | A | 10/1990 |

(Continued)

OTHER PUBLICATIONS

Key-Pak Child Resistant Senior Friendly Blister Card, Indication of Patent Pending. Keystone Folding Box Co. Newark, NJ.

(Continued)

*Primary Examiner*—Bryon P. Gehman
(74) *Attorney, Agent, or Firm*—Workman Nydegger

(57) ABSTRACT

A blister pack includes a cavity sheet including at least one product blister and an access blister associated with each of the at least one product blister, and a child resistant backing coupled to the cavity sheet, the child resistant backing including a weakened pattern corresponding with each of the at least one product blister formed in the cavity sheet, wherein the access blister includes a generally V-indent member configured to initiate a separation of the weakened pattern. The V-indent member focuses forces to allowing easy access to the product blister by adults, including seniors, while maintaining child resistant standards.

32 Claims, 7 Drawing Sheets

U.S. PATENT DOCUMENTS

| | | | | |
|---|---|---|---|---|
| 4,401,210 | A | 8/1983 | Anjou | |
| 4,506,789 | A | 3/1985 | Dlugosz | |
| 4,537,312 | A | 8/1985 | Intini | |
| 4,553,670 | A | 11/1985 | Collens | |
| 4,561,544 | A | 12/1985 | Reeve | |
| 4,567,986 | A | 2/1986 | Eastwood | |
| 4,669,613 | A | 6/1987 | Collens | |
| 4,844,284 | A | 7/1989 | Drozd et al. | |
| 4,884,693 | A | 12/1989 | Brutsch | |
| 4,974,729 | A | 12/1990 | Steinnagel | |
| 4,988,004 | A | 1/1991 | Intini | |
| 5,046,618 | A | 9/1991 | Wood | |
| 5,080,222 | A | 1/1992 | McNary | |
| 5,082,137 | A | 1/1992 | Weinstein | |
| 5,088,603 | A | 2/1992 | Kirkpatrick | |
| 5,172,182 | A | 12/1992 | Wharton et al. | |
| 5,242,055 | A | 9/1993 | Pora | |
| 5,275,291 | A | 1/1994 | Sledge | |
| 5,310,060 | A | 5/1994 | Bitner et al. | |
| 5,323,907 | A | 6/1994 | Kalvelage | |
| 5,325,968 | A | 7/1994 | Sowden | |
| 5,329,750 | A | 7/1994 | Bagley et al. | |
| 5,339,960 | A | 8/1994 | Price | |
| 5,346,069 | A | 9/1994 | Intini | |
| 5,437,371 | A | 8/1995 | Lataix | |
| 5,469,968 | A | 11/1995 | Matthews et al. | |
| 5,489,025 | A | 2/1996 | Romick | |
| 5,511,665 | A | 4/1996 | Dressel et al. | |
| 5,551,567 | A | 9/1996 | Malone et al. | |
| 5,755,462 | A | 5/1998 | Lupi | |
| 5,758,774 | A | 6/1998 | Leblong | |
| 5,775,505 | A | 7/1998 | Vasquez et al. | |
| 5,785,180 | A | 7/1998 | Dressel et al. | |
| 5,833,072 | A | 11/1998 | Lambelet, Jr. | |
| 5,862,915 | A | 1/1999 | Plezia et al. | |
| 5,878,887 | A | 3/1999 | Parker et al. | |
| 5,878,888 | A | 3/1999 | Faughey et al. | |
| 5,894,930 | A | 4/1999 | Faughey et al. | |
| 5,908,208 | A | 6/1999 | Lapsker | |
| 5,915,559 | A | 6/1999 | Hulick et al. | |
| 5,927,500 | A | 7/1999 | Godfrey et al. | |
| 5,944,191 | A * | 8/1999 | Ray et al. | 206/532 |
| 6,021,901 | A | 2/2000 | Wolfe | |
| 6,024,222 | A | 2/2000 | Friberg et al. | |
| 6,036,016 | A | 3/2000 | Arnold | |
| 6,047,829 | A | 4/2000 | Johnstone et al. | |
| 6,161,699 | A | 12/2000 | Gartland | |
| 6,230,894 | B1 | 5/2001 | Danville | |
| 6,273,260 | B1 | 8/2001 | ColDepietro et al. | |
| 6,338,407 | B2 | 1/2002 | Danville | |
| 6,349,831 | B1 | 2/2002 | Buss | |
| 6,375,956 | B1 * | 4/2002 | Hermelin et al. | 206/531 |
| 6,394,275 | B1 | 5/2002 | Paliotta et al. | |
| 6,412,636 | B1 | 7/2002 | Jones et al. | |
| 6,422,391 | B1 | 7/2002 | Swartz | |
| 6,491,211 | B1 | 12/2002 | Evans et al. | |
| 6,543,209 | B1 | 4/2003 | Siegel et al. | |
| 6,571,790 | B1 | 6/2003 | Weinstein | |
| D478,810 | S | 8/2003 | Wilson | |
| 6,675,972 | B2 * | 1/2004 | Patterson | 206/531 |
| 6,681,935 | B1 | 1/2004 | Lewis | |
| 6,708,825 | B2 | 3/2004 | Filion et al. | |
| 6,726,015 | B2 | 4/2004 | Hulick | |
| 6,752,272 | B2 | 6/2004 | Jones et al. | |
| 6,951,282 | B2 | 10/2005 | Jones | |
| 2003/0062287 | A1 | 4/2003 | Gelardi et al. | |
| 2004/0026293 | A1 | 2/2004 | Hughes | |
| 2004/0050748 | A1 | 3/2004 | Ehrlund | |
| 2004/0108240 | A1 | 6/2004 | Ragot | |
| 2004/0182738 | A1 * | 9/2004 | Williams-Hartman | 206/531 |
| 2004/0182739 | A1 | 9/2004 | Williams-Hartman | |
| 2004/0188311 | A1 | 9/2004 | Paliotta et al. | |
| 2004/0188312 | A1 | 9/2004 | Stepowany | |
| 2004/0188315 | A1 | 9/2004 | Morita et al. | |
| 2005/0035023 | A1 | 2/2005 | Breu et al. | |
| 2005/0087474 | A1 | 4/2005 | Killinger | |
| 2005/0145532 | A1 | 7/2005 | Kancsar et al. | |
| 2005/0230282 | A1 | 10/2005 | Lapsker | |
| 2005/0274644 | A1 | 12/2005 | Williams-Hartman | |

FOREIGN PATENT DOCUMENTS

| | | | |
|---|---|---|---|
| EP | 1 293 436 | A | 3/2003 |
| FR | 2 764 274 | A | 12/1998 |
| WO | WO 00/15518 | A | 3/2000 |
| WO | WO 02/18229 | A1 | 3/2002 |

OTHER PUBLICATIONS

International Search Report for PCT/US2005/025492 issued Oct. 25, 2005.

* cited by examiner

SYSTEM AND A METHOD FOR A V-INDENT BLISTER OPENING CAVITY

BACKGROUND

It is generally known that pharmaceutical products may be distributed in a variety of forms. Single dose pharmaceutical products are commonly available in tablets, lozenges, capsules, and the like. It is also known that some pharmaceutical products can pose a health risk to young children who are unable to recognize the risks of ingesting such products.

Accordingly, recent efforts have been made to provide child resistant pharmaceutical product packaging that prevents a child from accessing the pharmaceutical while still providing access to adults. By designing child resistant pharmaceutical packaging, the likelihood of accidents caused by a child ingesting a pharmaceutical product are greatly reduced.

Blister card packages are one form of container commonly used for the child resistant packaging of pharmaceuticals, particularly for unit-dose packaging where the delivery of individually packaged dosage units to the consumer or patient is desirable. Generally, a conventional blister card package provides a container for individual dosages of the pharmaceutical, separately packaged for delivery to a consumer. Typically, a blister card package contains one or more individual dosages on a card where each dosage is independently sealed and can be readily detached along perforations. The blister card package is usually constructed of several layers. The top layer is a blister card cover that covers a cavity sheet or container form-stock constructed of a rigid material having integrally formed pharmaceutical blisters or cavities designed to hold a pharmaceutical dosage. The bottom of the cavity sheet is sealed to a lidding layer generally constructed of a foil or paper. Additionally, a thick child resistant backing sheet is typically coupled to the blister card cover and folded so that it is positioned adjacent to the lidding, thereby making the blister card packaging child resistant.

The blister package can be designed for removal of the pharmaceutical from the container in a variety of ways. In some packages, the pharmaceutical is removed by first removing a perforated section of the child resistant backing followed by pressing the pharmaceutical through a rupturable lidding. In other designs, the child resistant backing and the lidding are designed to be peeled off of the cavity sheet to expose and allow removal of the pharmaceutical. One example pharmaceutical package design is the Key-Pak design. The Key-Pak design includes a number of holes formed through the fold over card, each hole positioned adjacent to a corresponding pharmaceutical blister. The holes formed through the blister card cover allow an object to be forced through the holes directly to the child-resistant backing, thereby allowing separation and subsequent removal of the child resistant backing located adjacent to the desired pharmaceutical blister. While the Key-Pak design is sufficient for single row blister strips, the Key-Pak design requires the cutting of holes in the blister package to access pharmaceutical blisters located in the middle cavities of cavity sheets having multiple rows. The formation of extra holes in the blister package results in unnecessary added cost and time to the manufacture of the resulting pharmaceutical package.

In the formation of child resistant blister card packages, a balance is had between designing a blister that is both tamper resistant and hermetically sealed while being easily opened by adults but not by children. However, many conventional blister packages are difficult to open, particularly by seniors or others with impaired dexterity. In the case of rupturable blisters, difficulty in opening may result in damage to the pharmaceutical. Additionally, with respect to peel-apart blisters, the child resistant backing layers are often difficult to manipulate and separate because they are thin and tightly sealed.

SUMMARY

A blister pack includes a cavity sheet including at least one product blister and an access blister associated with each of the at least one product blister, and a child resistant backing coupled to the cavity sheet, the child resistant backing including a weakened pattern corresponding with each of the at least one product blister formed in the cavity sheet, wherein the access blister includes a generally V-indent member configured to initiate a separation of the weakened pattern.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

An exemplary system and method for forming and utilizing a V-indent access blister are described herein. More specifically, the present exemplary systems and methods provide for an access blister to be formed adjacent to each pharmaceutical blister formed in a blister pack. By exerting a downward force on the access blister, a focused point is created and caused to separate a child resistant backing, thereby initiating the easy removal of perforated sections of the child resistant backing. Both the structure and operation of the present blister pack will now be described in further detail below.

As used in this specification and in the appended claims, the term "pharmaceutical" is meant to be understood broadly as any medicinal structure or edible casing configured to house a substance related to a medicinal treatment. The medicinal structure can include an active ingredient for an approved medical treatment, a medical treatment being evaluated, or a placebo ingredient used during clinical trials to compare against the medical treatment being evaluated (i.e., a placebo capsule).

In the following description, for purposes of explanation, numerous specific details are set forth to provide a thorough understanding of the present system and method for forming and utilizing a V-indent access blister. It will be apparent, however, to one skilled in the art, that the present systems and processes may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 1:
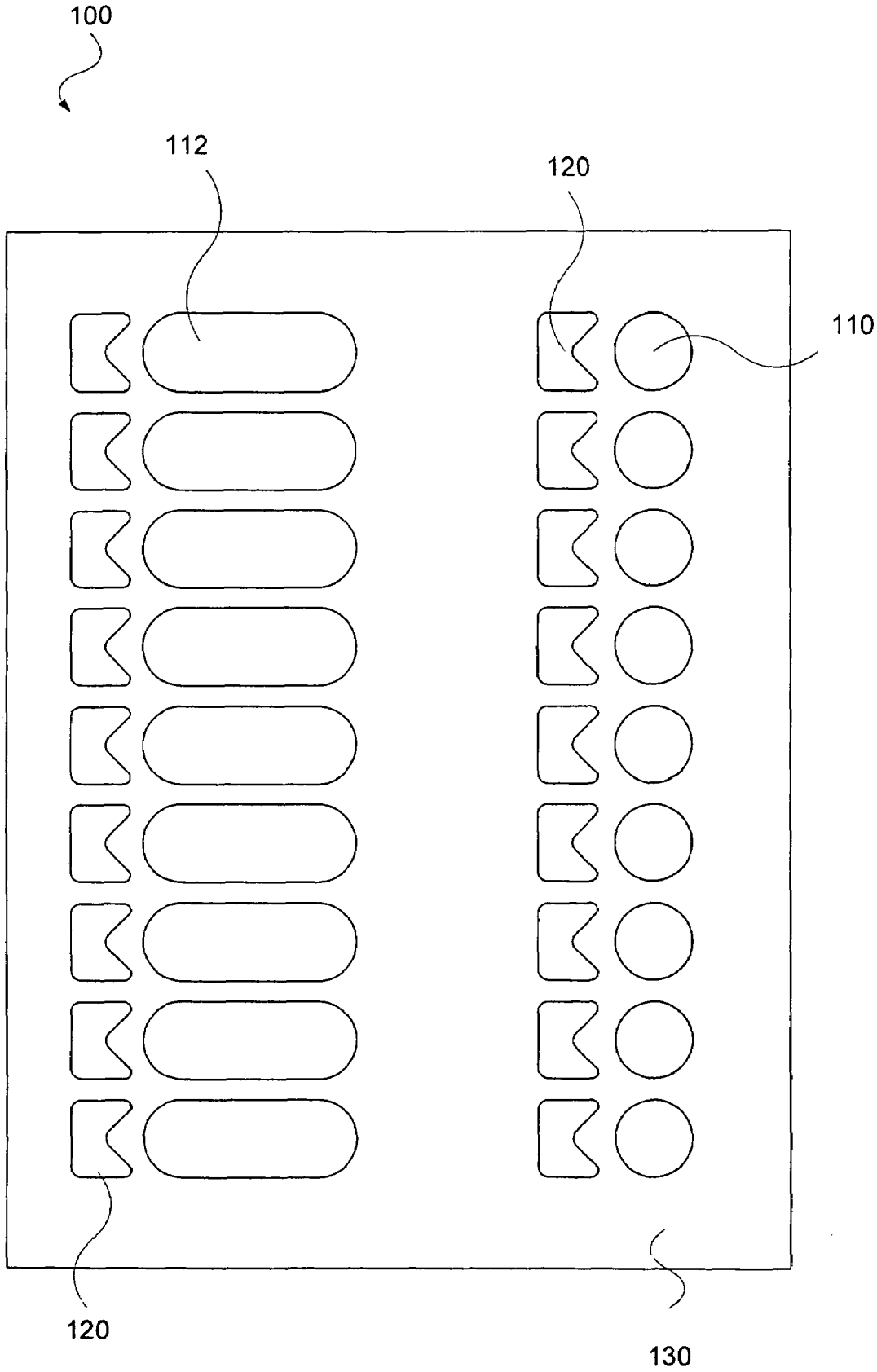
FIG. 1 is a top view illustrating a cavity sheet having a V-indent blister opening cavity, according to one exemplary embodiment.

FIG. 1 is a top view illustrating the cavity sheet (130) of a blister pack (100) including an access blister (120) associated with each pharmaceutical blister (110, 112) formed therein. As shown, the cavity sheet (130) of the blister pack (100) includes a plurality of pharmaceutical blisters that may assume a round (110), oval (112), or other shape corresponding to a desired pharmaceutical. The plurality of pharmaceutical blisters (110, 112) formed in the blister pack (100) may all have identical or varying sizes corresponding to desired pharmaceuticals. According to one exemplary embodiment, the cavity sheet (130) may be formed out of any number of planar thermoplastic materials, foil, or any other formable materials. During formation of an exemplary thermoplastic cavity sheet (130), the thermoplastic cavity sheet may be thermoformed to produce a number of access blisters (120) and their associated plurality of pharmaceutical blisters (110, 112), configured to house a pharmaceutical product such as a drug capsule, a tablet, a caplet, or a gelcap. Thermoforming is a process of forming a thermoplastic sheet into a three-dimensional shape by clamping the sheet in a frame, heating the thermoplastic sheet to tender it soft and flowable, and then applying a differential pressure to make the sheet conform to the shape of a mold or die positioned below the frame. Additionally, the cavity sheet may be formed using any number of forming methods including, but in no way limited to, coldforming using a male shaped plug that presses a sheet material into a female cavity, thereby forming the pharmaceutical blisters (110, 112).

Figure 2:
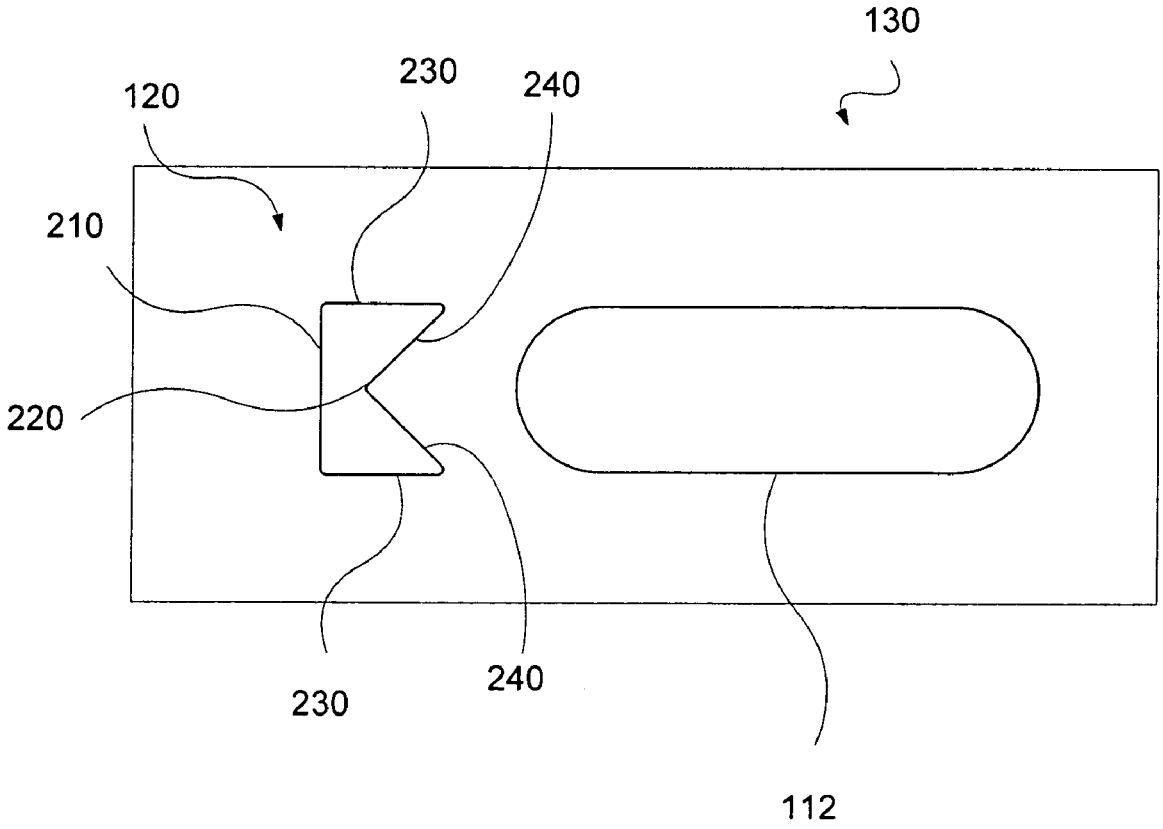
FIG. 2 is a top view illustrating a blister layer of a single dosage pharmaceutical blister pair, according to one exemplary embodiment.
Figure 3:
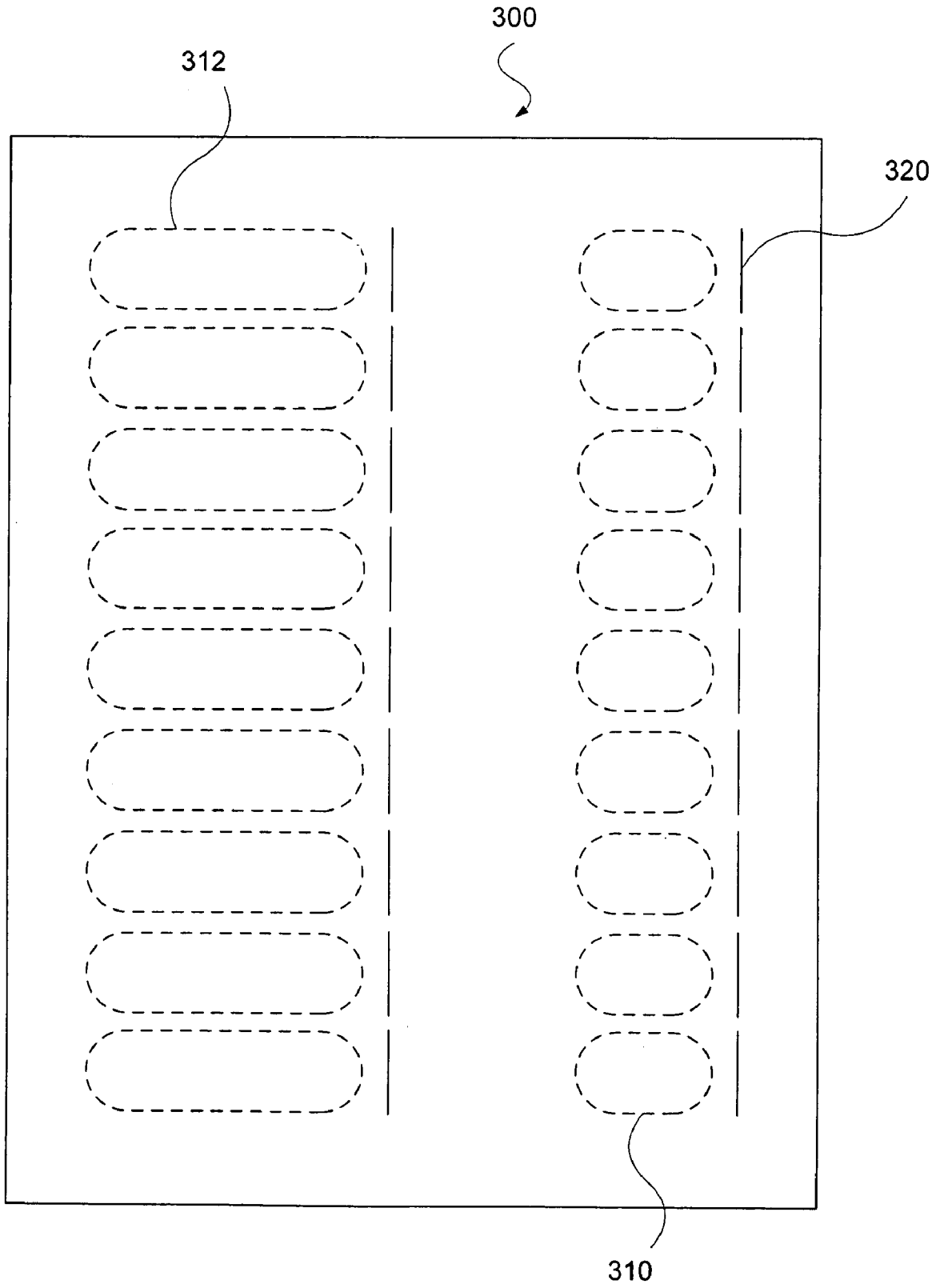
FIG. 3 is a bottom view illustrating perforated sections of a child resistant backing, according to one exemplary embodiment.

Laterally aligned with and precisely spaced from each pharmaceutical blister (110, 112) formed within the cavity sheet (130) is a corresponding second cavity or access blister (120). FIG. 2 illustrates a top view of an oval pharmaceutical blister (112) and its associated access blister (120), according to a first exemplary embodiment. As illustrated in FIG. 2, the exemplary access blister (120) is an extrusion formed in the cavity sheet (130) adjacent to the oval pharmaceutical blister (112). While the exemplary access blister (120) and the oval pharmaceutical blister (112) illustrated in FIG. 2 are linearly arranged, the access blister (120) and the oval pharmaceutical blister (112) pairs may be oriented in any number of directions with respect to each other provided that the weakened patterns (310, 312; FIG. 3) of the child resistant backing (300; FIG. 3) correspond to the blister pair orientation as further described in FIG. 3. Continuing with FIG. 2, the access blister (120) includes a front member (210) coupled to a first end of a side member (230) at each end thereof in a substantially perpendicular orientation. The front member (210) defines the edge of the access blister (120) opposite the pharmaceutical blister (112). Additionally, as illustrated in FIG. 2, a second end of each side member (230) is coupled to an opposing end of a "V-indent" member comprising a plurality of legs (240) that intersect at a termination location (220), which is ideally a single sharp point. According to one exemplary embodiment, the legs (240) intersect into a sharp point, subject to the manufacturing limitations of the blister pack. By intersecting the legs (240) at a sharp point, an application of a force on the top surface of the access blister (120) may be translated to the sharp point when the applied force is sufficient to invert the access blister (120). Consequently, the focusing of the force to a sharp point at the intersection location readily pierces the child-resistant backing. According to the exemplary embodiment illustrated in FIG. 2, the "V-indent" member formed by the intersecting legs (240) is oriented towards the front member (210) and forms a concave opening when viewed from the perspective of the associated oval pharmaceutical blister (112).

While the access blister (120) is illustrated in FIG. 2 as having the same approximate width as the oval pharmaceutical blisters (112) and a relatively shorter length, the relative size of the access blister (120) may vary. That is, the access blister (120) may be formed either wider or narrower than the width of its associated oval pharmaceutical blisters (112). Additionally, the access blister (120) may be formed relatively longer or shorter than illustrated in FIG. 2. By increasing the length of the access blister (120), the length of the legs (240) may also be varied. Consequently, the legs (240) joining at the termination location (220) may be varied, allowing a relative increase or decrease in the resulting collapsed depth of the termination location. While the relative dimensions of the access blister (120) may vary as illustrated above, the unified access blister size and orientation illustrated in FIG. 2 are sized and positioned to minimize any loss of valuable pharmaceutical space and are typically smaller than the size of a pharmaceutical received in a pharmaceutical space, etc.

The present exemplary access blister (120) has been described above and illustrated in the associated Figures as having a "V-indent" member comprising a plurality of lever legs (240) joining at a termination location (220). However, any number of generally V shaped profiles may be formed in a blister to serve as an access blister (120) configured to concentrate a force initially applied on a large top surface to a smaller area on the opposite side of the large surface, upon collapse of the blister. By increasing the area of the initial force receiving surface, the application of force sufficient to separate a child resistant backing (300; FIG. 3) is reduced. The term "generally V shaped profiles" is to be understood both here and in the appended claims as referring to any profile having two or more lever legs (240) joining at one or more termination locations (220), regardless of the cross-sectional profile of the two or more lever legs or the relative area of the termination location.

As will be further explained below with reference to FIGS. 6 through 9, the access blister (120) is designed, when forced by a user, to initially collapse along the lever arms (240) defining the V-indent member, thereby forcing the termination location (220) to be inverted and to bear upon a perforated portion of a child resistant backing. By focusing the collapsing energy of the V-indent member to a specific termination location (220), breech of a perforated portion (310, 312; FIG. 3) of the child resistant backing (300; FIG. 3) is facilitated, thereby forming a pull tab (800; FIG. 8). The pull tab may then be used to peel the perforated portion of the child resistant backing from the cavity sheet (130). The present system and method allow for access to the pull tab (800; FIG. 8) corresponding to any of the pharmaceutical blisters (110, 112; FIG. 1) without regard to their respective position on the cavity sheet.

FIG. 3 is a bottom view of a blister pack (100; FIG. 1) including a child resistant backing (300) having a perforated or otherwise weakened pull-tab pattern (310, 312) associated with each pharmaceutical blister (110, 112; FIG. 1) and its associated access blister (120). The child resistant backing (300) coupled to the back of the cavity sheet (130; FIG. 1) may be made out of any substantially strong material configured to prevent the push through of a pharmaceutical including, but in no way limited to, paperboard such as solid bleached sulfate type paperboard or a plastic material.

While the child resistant backing (300) prevents the push through of a pharmaceutical, the weakened pattern (310, 312) formed in the child resistant backing allows for selective removal of the child resistant backing. The weakened pattern (310, 312) may be a perforated, slotted, scored, or otherwise weakened pattern associated with each pharmaceutical blister (110, 112; FIG. 1) and access blister (120; FIG. 1) pair configured to act as a removable pull-tab when breeched. According to one exemplary embodiment, the weakened pattern (310, 312) substantially corresponds in size and shape with a pharmaceutical blister (110, 112; FIG. 1) and access blister (120; FIG. 1) pair. That is, a relatively long oval weakened pattern (312) will correspond to an oval pharmaceutical blister (112; FIG. 1) configured to house a capsule or other oval pharmaceutical, while a shorter weakened pattern (310) will correspond with a round pharmaceutical blister (110; FIG. 1). Moreover, a portion of the weakened pattern (310, 312) is oriented beneath the termination location (220) of the lever legs (240) defining the V-indent member. Accordingly, as discussed in further detail below, the access blister (120; FIG. 1) is configured to deform in response to the application of force, so as to focus the termination location (220; FIG. 2) of the V-indent member towards a localized point of the weakened pattern (310, 312).

FIG. 3 also illustrates a pull tab stop (320) associated with each weakened pattern (310, 312) formed in the child resistant backing (300). According to one exemplary embodiment, the pull tab stop (320) is configured to aid in the removal of the weakened pattern (310, 312) when displaced from the child resistant backing (300). As shown in FIG. 3, a pull tab stop (320) is formed adjacent to each weakened pattern (310, 312), on the end opposite the access blister (120; FIG. 1). Once the weakened pattern (310, 312) is breeched, it may be removed by a user pulling on the breeched portion of the pattern functioning as a pull tab. If the portion of the child resistant backing (300) defined by the weakened pattern (310, 312) is pulled and does not tear along the weakened pattern, propagation of the unwanted tear will be halted as the tear joins the pull tab stop (320), prior to its continuation to the backing adjacent to additional pharmaceutical blisters (110, 112; FIG. 1). According to one exemplary embodiment, there may be one or more pull tab stops (320) corresponding to each weakened pattern (310, 312).

Figure 4:
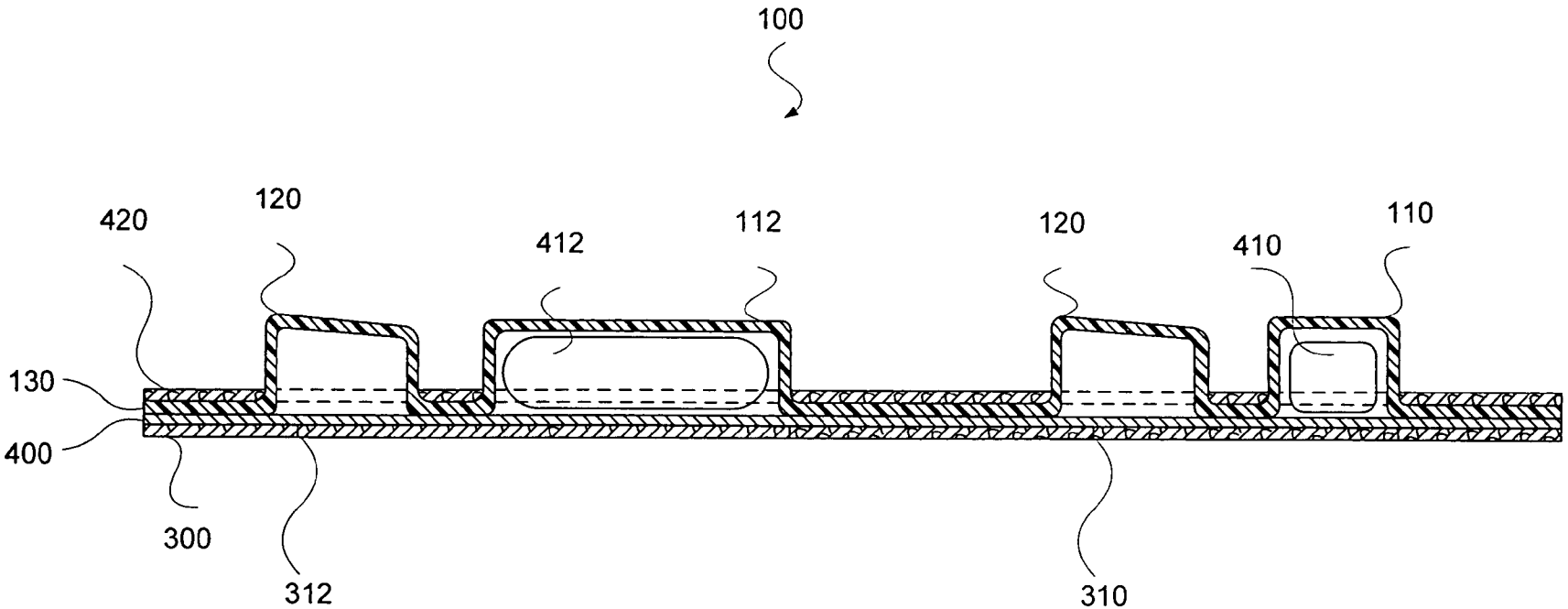
FIG. 4 is a cut away side view illustrating an assembled pharmaceutical blister pack, according to one exemplary embodiment.

FIG. 4 is a cut away view of an assembled blister pack (100) sectioned through a plurality of pharmaceutical blisters (110, 112) and access blisters (120), according to one exemplary embodiment. As mentioned previously, the blister pack (100) includes a cavity sheet (130) having a number of access blisters (120) and pharmaceutical blisters (110, 112) formed therein. Additionally, as illustrated in FIG. 4, a circular pharmaceutical (410) is disposed within the round pharmaceutical blister (110) and an oval pharmaceutical (412) is disposed within the oval pharmaceutical blister (112). While the assembled blister pack (100) illustrated in FIG. 4 is described as having both an oval pharmaceutical (412) and a circular pharmaceutical, the present system and method may be incorporated by a blister pack containing any type of pharmaceuticals including, but in no way limited to, a drug capsule, a tablet, a caplet, or a gelcap assuming any number of shapes.

FIG. 4 also illustrates a lidding (400) coupled between the cavity sheet (130) and the child resistant backing (300). The lidding (400) is configured to keep the pharmaceuticals (410, 412) contained within the pharmaceutical blisters (110, 112) under a hermetic seal. According to one exemplary embodiment, the lidding (400) is heat sealed completely about the perimeter of each pharmaceutical blister (110, 112). The lidding (400) may be formed out of any number of rupturable, yet sealable materials including, but in no way limited to, a foil.

FIG. 4 also illustrates a fold over card cover (420) being disposed on top of the cavity sheet (130). According to one exemplary embodiment, the fold over card cover (420) and the child resistant backing (300) are coupled so as to secure the components of the blister pack (100) there between. While a fold over card configuration is illustrated in FIG. 4, the present blister pack configuration is in no way limited to any specific blister pack configuration.

Figure 5:
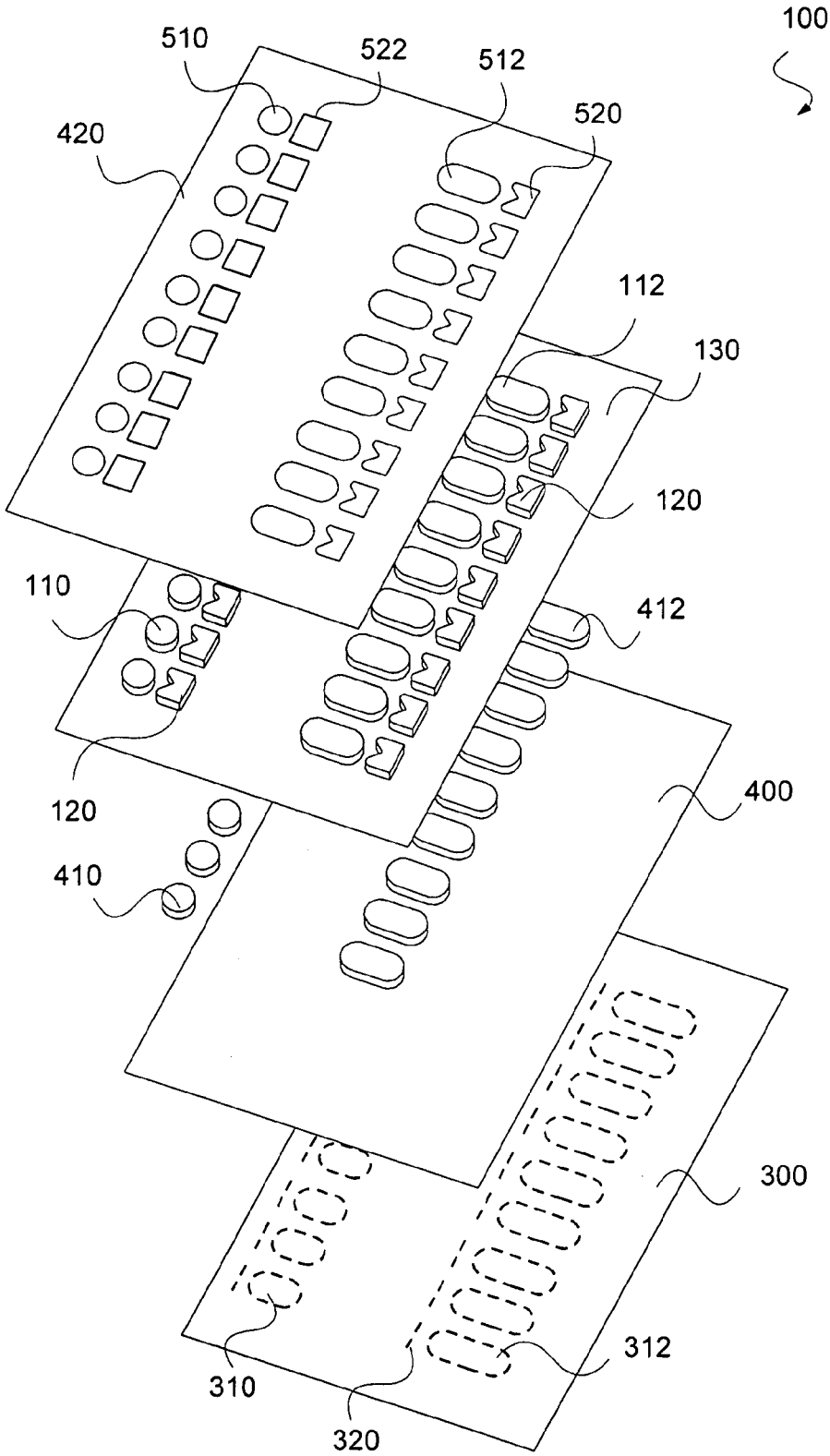
FIG. 5 is an exploded perspective view illustrating the components of a pharmaceutical blister pack, according to one exemplary embodiment.

FIG. 5 is an exploded perspective view further illustrating the assembly of the exemplary blister pack (100). As shown in FIG. 5, the fold over card cover (420) includes a number of pharmaceutical blister orifices (510, 512) and access blister orifices (520, 522) corresponding in shape and size to the various pharmaceutical blisters (110, 112) and access blisters (120) formed in the cavity sheet (130). Accordingly, the fold over card cover (420) will fit onto the cavity sheet (130), allowing the pharmaceutical blisters (110, 112) and the access blisters (120) to pass through corresponding orifices. This configuration allows the fold over card cover (420) to be flush with, and/or coupled to the planar surface of the cavity sheet (130). As illustrated in FIG. 5, the access blister orifices (520, 522) may vary in shape, so long as the resulting orifice sufficiently couples the cavity sheet (130) while permitting the passage of the access blisters (120) during assembly. An orifice is considered to sufficiently couple a cavity sheet (130) if it sufficiently surrounds the cavity sheet to retain the cavity sheet while maintaining the child resistant functionality of the child resistant backing (300; FIG. 3). FIG. 5 illustrates both a rectangular access blister orifice (522) and an access blister shaped orifice (520). However, a number of alternative access blister shaped orifices (520, 522) may be used including, but in no way limited to, a single orifice that permits the passage of both an access blister (120) and a pharmaceutical blister (110, 112) while sufficiently coupling a cavity sheet (130) as explained above.

FIG. 5 also illustrates the pharmaceuticals (410, 412) corresponding to their respective pharmaceutical blisters (110, 112). The pharmaceuticals (410, 412) are then hermetically sealed by the lidding (400) and the child resistant backing (300) having weakened patterns (310, 312) formed therein. While all of the components illustrated in the exploded view of FIG. 5 may be joined to form a blister pack (100), a number of the illustrated components may be removed without varying the teachings of the present system and method.

Figure 6:
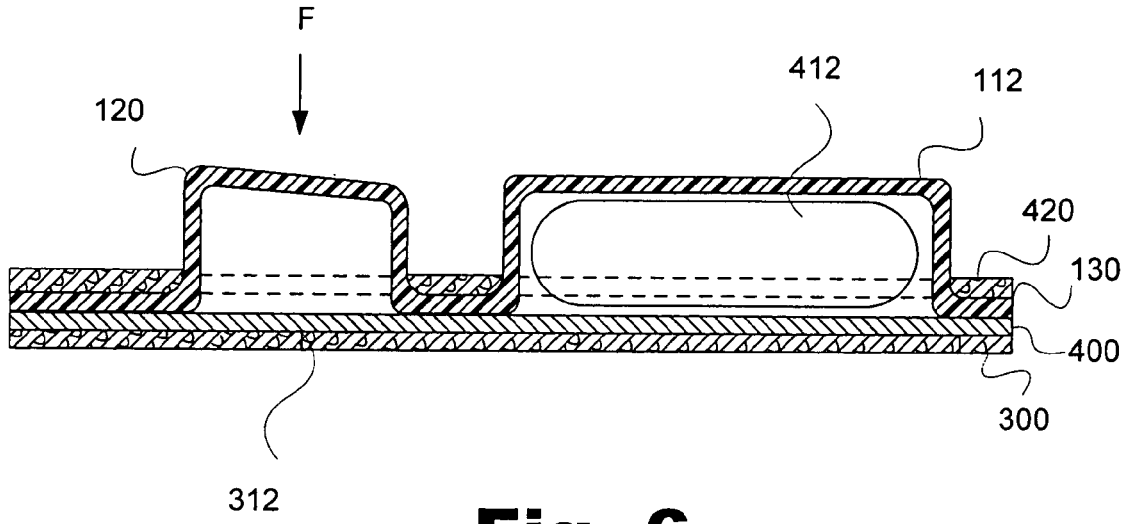
FIG. 6 is a cross-sectional side-view illustrating the function of the V-indent access blister, according to one exemplary embodiment.

FIGS. 6 through 9 illustrate the operation of the above-mentioned blister pack configuration. More specifically, FIGS. 6 through 9 illustrate how the above-mentioned structure may be manipulated to provide child resistant protection of pharmaceuticals (410, 412) while facilitating easy removal of the child resistant backing (300) and access to the pharmaceutical blisters (110, 112). While FIGS. 6 through 9 illustrate obtaining access to an oval pharmaceutical (412) contained within an oval shaped blister (112), the present system and method may be used in association with circular (110; FIG. 1) or other shaped blisters. As illustrated in FIG. 6, an oval shaped pharmaceutical (412) may be accessed from the present system by initially applying a force (F), in the direction indicated by the arrow, on a top surface of an access blister (120) associated with a pharmaceutical blister (112) containing the desired pharmaceutical.

Figure 7:
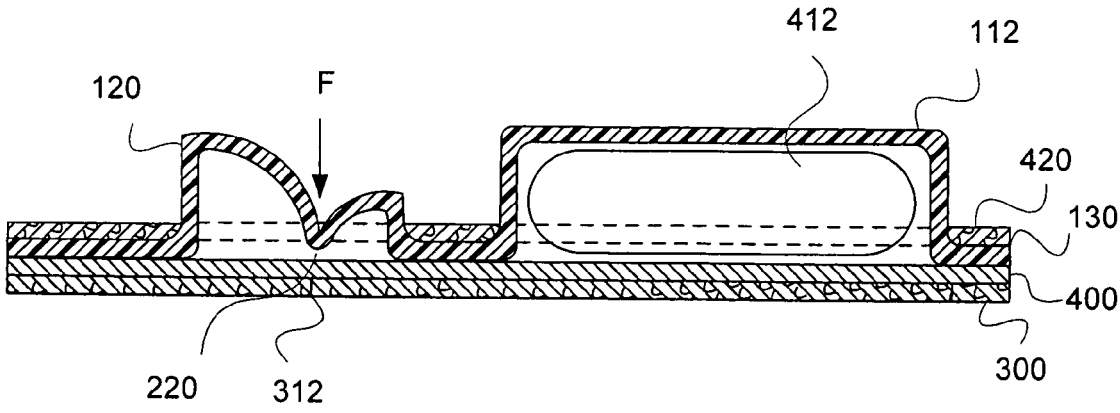
FIG. 7 is a cross-sectional side-view illustrating the operation of the V-indent access blister upon the application of force, according to one exemplary embodiment.
Figure 8:
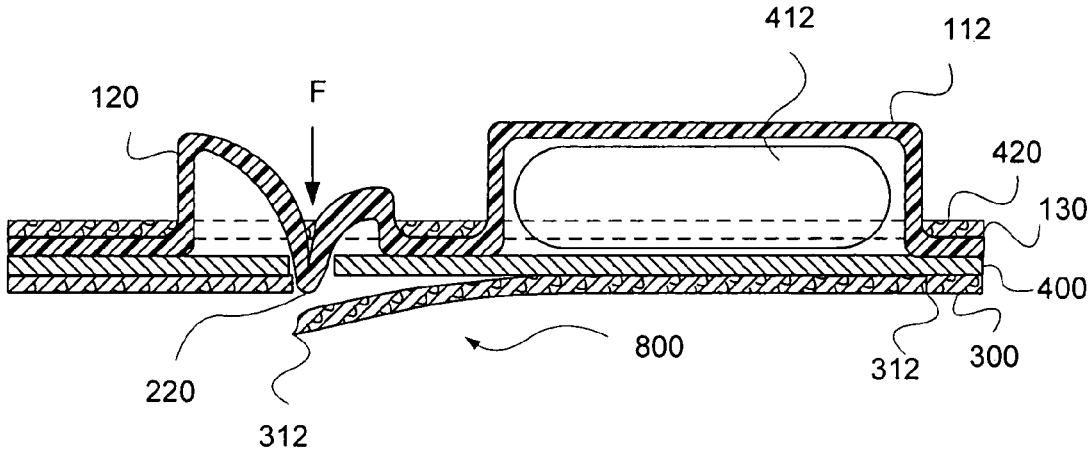
FIG. 8 is a cross-sectional side-view illustrating the separation of a perforated section of a child resistant backing using the V-indent access blister, according to one exemplary embodiment.

As shown in FIG. 7, the application of the force (F) will initiate a deformation of the hollow access blister (120). The V-indent member defined by the lever legs (240; FIG. 2) of the access blister (120) is configured to initially collapse into its hollow interior upon the application of the force (F), causing the termination location (220) of the V-indent member to be oriented towards the child resistant backing (300), as shown. Accordingly, the deformed access blister (120) substantially resembles an inverted pyramid as the termination location (220) continues towards the child resistant backing (300). The termination location (220) forms a focused point of the deformed access blister (120). As mentioned previously, the termination location (220) of the V-indent member is positioned adjacent to the weakened pattern (312) of the child resistant backing (300).

As the force (F) is applied to the access blister (120), the termination location (220) will pass through the lidding (400) and disrupt a portion of the weakened pattern (312) of the child resistant backing (300) positioned adjacent to the contact point as illustrated in FIG. 8. When the termination location (220) of the access blister (120) disrupts the weakened pattern (312) of the child resistant backing (300), a portion of the child resistant backing, defined by the weakened pattern, is separated and may be used as a pull tab (800).

Figure 9:
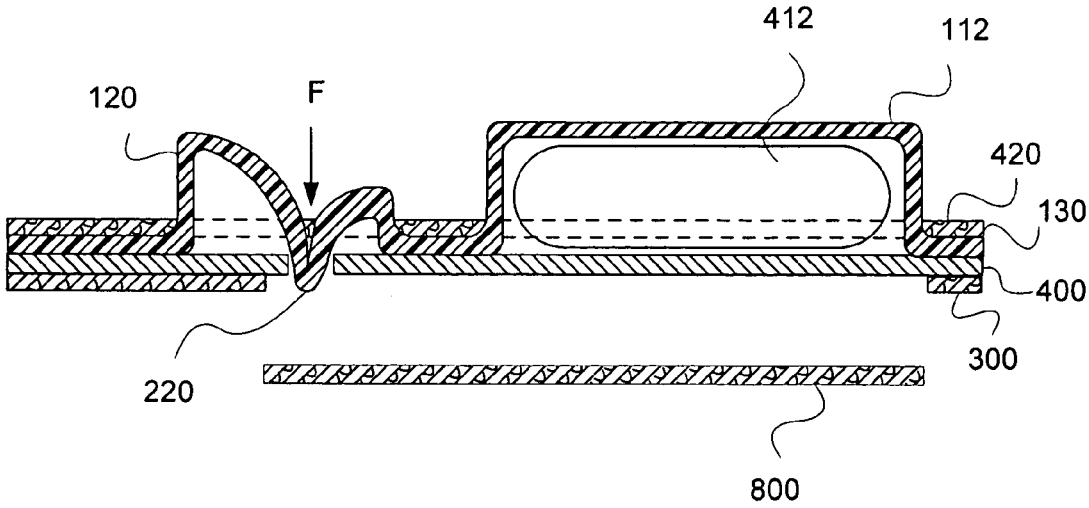
FIG. 9 is a cross-sectional side-view illustrating separated perforated section of a child resistant backing, according to one exemplary embodiment.

The pull tab (800) can then be grasped between the forefinger and thumb of a user and be peeled back, revealing the foil lidding (400). The pull tab (800) may be peeled back along the weakened pattern (312) until it is completely removed as illustrated in FIG. 9. If pulling the pull tab (800) produces a tear that does not focus the weakened pattern, its propagation will be halted by the pull tab stop (320; FIG. 3). Once the pull tab (800) defined by the weakened pattern (312) is removed, the pharmaceutical (412) may be easily pushed through the lidding (400), if present, or merely removed from the pharmaceutical blister (112) if the lidding (400) is not present.

When collapsed by the application of force (F), and as a consequence of the orientation of the access blister (120) with respect to the weakened pattern (312) of the child resistant backing (300), the V-indent member (240; FIG. 2) of the access blister produces a termination location (220) or contact point against or adjacent to the weakened pattern of the child resistant backing. Consequently, a substantial percentage of the force applied to the access blister (120) is focused to the termination location (220), causing the weakened pattern (312) to be overcome with the application of only a relatively small amount of pressure on the top surface of the access blister (120).

Additionally, it will be appreciated from the foregoing that one not understanding the procedure required to effect a rupture of the child resistant backing (300), permitting it to be peeled back to give access to the pharmaceutical blisters, will not be able to access the pharmaceuticals. Consequently, the present system and method also provides child resistant blister strip packages for pharmaceuticals.

While FIGS. 6 through 9 are illustrated in the context of a single oval pharmaceutical blister (112) associated with a single access blister (120), it will be understood that the structures and methods illustrated in FIGS. 6, 7, 8 and 9 can be incorporated into a single dosage application, a multiple unit strip, single blisters with multiple rows being filled with multiple drugs, and other similar configurations. Additionally, the exemplary blister packs (100; FIG. 1) disclosed herein may be joined to additional components including, but in no way limited to, child resistant housings, boxes, packages, etc.

Moreover, while the above-mentioned exemplary embodiments have been described in the context of a child resistant pharmaceutical blister pack, the present systems and methods may be used with any number of blister packs. Consequently, the present systems and methods may be used to enhance child resistant blister packs containing items such as, but in no way limited to, sterile instruments, electronics, and/or contact lenses.

In conclusion, the present systems and methods for forming and utilizing a V-indent access blister provide for child resistant pharmaceutical delivery while facilitating adult access to desired pharmaceuticals. More specifically, the present blister pack configuration provides a V-indent access blister that, when actuated by the application of pressure, deforms to focus the applied pressure to a weakened pattern located on the child resistant backing. As a result, the present V-indent blister opening cavity allows easy access to pharmaceutical blisters by adults, including seniors, while maintaining child resistant standards. Additionally, the present system and method utilizes conventional materials and can be manufactured using conventional equipment.

The preceding description has been presented only to illustrate and describe exemplary embodiments of the present systems and methods. It is not intended to be exhaustive or to limit the systems and methods to any precise form disclosed. Many modifications and variations are possible in light of the above teaching. It is intended that the scope of the systems and methods be defined by the following claims.

What is claimed is:

1. A blister pack comprising:

a cavity sheet including at least one product blister and an access blister associated with each said product blister, each said access blister at least partially bounding a corresponding cavity; and a child resistant backing coupled to said cavity sheet, said child resistant backing including a weakened pattern formed in said child resistant backing corresponding with each said product blister;

wherein each said access blister comprises a top member and a sidewall extending from said top member and encircling said corresponding cavity, said side wall comprising a V-indent member projecting into said corresponding cavity that includes a first leg member and a second leg member joining at an intersection location, the V-indent member being configured to initiate a separation of each said weakened pattern.

2. The blister pack of claim 1, wherein said sidewall of each said access blister further comprises:

a front member having a first end and a second end both spaced apart from the product blister associated with the access blister;

a first side member coupled to said first end of said front member, said first side member extending away from said front member and toward said associated product blister; and a second side member coupled to said second end of said front member, said second side member extending away from said front member and toward said associated product blister, said V-indent member extending between said first side member and said second side member.

3. The blister pack of claim 2, wherein each said access blister is configured to:

receive a force;

structurally deform in response to the received force; and transmit the force to said intersection location to initiate a separation of said weakened pattern.

4. The blister pack of claim 3, wherein each said access blister further comprises:

said top member coupling said front member, said first and second side members, and said first and second leg members;

said top member having a larger surface area than said intersection location; and wherein the force is applied to said top member and translated to said intersection location upon said structural deformation.

5. The blister pack of claim 1, further comprising a lidding disposed between said cavity sheet and said child resistant backing; and wherein said lidding is configured to hermetically seal said at least one product blister.

6. The blister pack of claim 5, wherein said lidding comprises a foil or paper.

7. The blister pack of claim 5, wherein each said access blister is configured to initiate a separation of said lidding.

8. The blister pack of claim 1, further comprising a fold over card disposed on said cavity sheet;

wherein said fold over card includes a plurality of orifices formed therein, said plurality of orifices being associated with said at least one product blister and its associated access blister.

9. The blister pack of claim 1, wherein each said product blister is configured to house a pharmaceutical.

10. The blister pack of claim 1, wherein each said product blister is configured to house one of a sanitary instrument, an electronic component, or a contact lens.

11. The blister pack of claim 1, wherein said at least one product blister and its associated access blister are thermo formed in said cavity sheet.

12. The blister pack of claim 1, wherein each said weakened pattern comprises one of a perforation, a slot, or a score.

13. The blister pack of claim 1, wherein each said weakened pattern comprises a pull tab.

14. The blister pack of claim 1, further comprising a pull tab stop fanned in said child resistant backing adjacent to an end of each said weakened pattern.

15. A child resistant pharmaceutical blister package comprising:

a cavity sheet including at least one pharmaceutical blister configured to house a pharmaceutical and an access blister associated with each said pharmaceutical blister; and a child resistant backing coupled to said cavity sheet, said child resistant backing including a weakened pattern corresponding with each said pharmaceutical blister formed in said child resistant backing;

wherein each said access blister comprises a V-indent member comprising a first leg member and a second leg member joining at an intersection location, an openly exposed notch being bounded between the said first leg member and said second leg member, at least a portion of said intersection location pushing a portion of said child resistant backing away from said cavity sheet when said access blister is pressed toward said child resistant backing.

16. The child resistant pharmaceutical blister package of claim 15, wherein each said access blister further comprises:

a front member having a first end and a second end both spaced apart from the pharmaceutical blister associated with the access blister;

a first side member coupled to said first end of said front member, said first side member extending away from said front member and toward said associated pharmaceutical blister; and a second side member coupled to said second end of said front member, said second side member extending away from said front member and toward said associated pharmaceutical blister, said V-indent member extending between said first side member and said second side member.

17. The child resistant pharmaceutical blister package of claim 15, further comprising a lidding disposed between said cavity sheet and said child resistant backing;

wherein said lidding is configured to hermetically seal said at least one pharmaceutical blister.

18. The child resistant pharmaceutical blister package of claim 17, wherein said lidding comprises a foil or paper.

19. The child resistant pharmaceutical blister package of claim 17, wherein each said access blister is configured to initiate a separation of said lidding.

20. The child resistant pharmaceutical blister package of claim 15, further comprising a fold over card disposed on said cavity sheet;

wherein said fold over card includes a first side having a plurality of orifices associated with said at least one pharmaceutical blister and its associated access blister formed in said cavity sheet, and a second side forming said child resistant backing.

21. The child resistant pharmaceutical blister package of claim 15, wherein said at least one pharmaceutical blister and its associated access blister are thermoformed in said cavity sheet.

22. The child resistant pharmaceutical blister package of claim 15, wherein each said weakened pattern comprises one of a perforation, a slot, or a score.

23. The child resistant pharmaceutical blister package of claim 15, wherein each said weakened pattern defines a pull tab formed in said child resistant backing.

24. A child resistant pharmaceutical blister package comprising:

a cavity sheet including at least one pharmaceutical blister configured to house a pharmaceutical and an access blister associated with each said pharmaceutical blister thermoformed in said cavity sheet; and a child resistant backing coupled to said cavity sheet, said child resistant backing including a weakened pattern corresponding with each said pharmaceutical blister formed in said child resistant backing, each said weakened pattern including one of a perforation, a slot, or a score;

wherein each said access blister includes a front member having a first end and a second end both disposed spaced apart from the pharmaceutical blister associated with the access blister, a first side member coupled to said first end of said front member, said first side member extending away from said front member and toward said associated pharmaceutical blister, a second side member coupled to said second end of said front member, said second side member extending away from said front member and toward said associated pharmaceutical blister, and a generally V-shaped member, said V-shaped member including a first leg member and a second leg member joining at an intersection location, each said access blister being configured to initiate a separation of each said weakened pattern.

25. The child resistant pharmaceutical blister package of claim 24, further comprising a foil lidding disposed between said cavity sheet and said child resistant backing;

wherein said foil lidding is configured to hermetically seal said at least one pharmaceutical blister.

26. The child resistant pharmaceutical blister package of claim 24, further comprising a fold over card disposed on said cavity sheet;

wherein said fold over card includes a first side having a plurality of orifices associated with said at least one pharmaceutical blister and its associated access blister formed in said cavity sheet, and a second side fanning said child resistant backing.

27. A blister pack comprising:

a cavity sheet including at least one product blister and an access blister associated with each said product blister; and a child resistant backing coupled to said cavity sheet, said child resistant backing including a weakened pattern formed in said child resistant backing corresponding with each said product blister;

wherein each said access blister includes an indent member forming a focused point, said focused point pushing a portion of said child resistant backing away from said cavity sheet when its said access blister is pressed toward said child resistant backing.

28. The blister pack of claim 27, further comprising a lidding disposed between said cavity sheet and said child resistant backing, said focused point piercing through said lidding when said access blister is pressed toward said child resistant backing.

29. The blister pack of claim 27, wherein said access blister comprises a top member and a sidewall that projects from said top member and encircles a cavity of said access blister, said indent member projecting from said top surface into said cavity.

30. The blister pack of claim 29, wherein said cavity sheet has a top surface and an opposing bottom surface, said focused point of said indent member moves from one side of comprises a top member and a sidewall that projects from said top member and encircles a cavity of said access blister, said indent member projecting from said top surface into said cavity.

31. The blister pack of claim 27, wherein each said weakened pattern comprises one of a perforation, a slot, or a score.

32. A method for opening a blister pack, the method comprising:

pressing on an access blister formed on a cavity sheet so that a focused point extending from the access blister penetrates through a lidding coupled to the cavity sheet and outwardly pushes a portion of a child resistant backing mounted over the lidding;

pulling away the portion of the child resistant backing from the lidding so as to uncover a portion of the lidding that covers an opening to a product blister formed on the cavity sheet; and pressing on the product blister so that a pharmaceutical located within the product blister penetrates through the uncovered portion of the lidding.

* * * * *